United States Patent [19]

Derderian

[11] Patent Number: 4,541,836

[45] Date of Patent: Sep. 17, 1985

[54] FUEL COMPOSITIONS

[75] Inventor: Edmond J. Derderian, Charleston, W. Va.

[73] Assignee: Union Carbide Corporation, Danbury, Conn.

[21] Appl. No.: 448,280

[22] Filed: Dec. 9, 1982

[51] Int. Cl.[4] ..... C10L 1/18

[52] U.S. Cl. ..... 44/53; 44/56

[58] Field of Search ..... 44/53, 56; 568/715

[56] References Cited

U.S. PATENT DOCUMENTS

| | | | |
|---|---|---|---|
| 1,774,180 | 8/1930 | Mann, Jr. | 44/56 |
| 2,104,021 | 4/1935 | Callis | 44/69 |
| 3,822,119 | 7/1974 | Frech et al. | 44/51 |
| 4,207,076 | 6/1980 | Bove et al. | 44/56 |
| 4,207,077 | 6/1980 | Bove et al. | 44/56 |
| 4,298,354 | 11/1981 | Hardman et al. | 44/56 |
| 4,384,872 | 5/1983 | Kester et al. | 44/56 |

OTHER PUBLICATIONS

96:202202K, Chem. Abstracts, vol. 96, p. 151, Schmidt, Institute Fuel Technology, pp. 928–933.

*Primary Examiner*—William R. Dixon, Jr.
*Assistant Examiner*—Margaret B. Medley
*Attorney, Agent, or Firm*—Reynold J. Finnegan

[57] ABSTRACT

A phase-stable aqueous gasoline/ethanol fuel composition containing an additional alcohol selected from the group consisting of n-butanol, 2-butanol, iso-butanol, 2-methyl-1-butanol, 3-methyl-1-butanol, n-pentanol, and mixtures thereof, as well as a method for producing said fuel composition.

9 Claims, No Drawings

FUEL COMPOSITIONS

BRIEF SUMMARY OF THE INVENTION

TECHNICAL FIELD

This invention pertains to highly phasestable gasoline-alcohol fuel compositions for use in internal combustion engines and to a method for preparing said compositions.

BACKGROUND OF THE INVENTION

There is always a need to improve the quality and performance of motor gasoline. Particular beneficial improvements desired include, e.g. lower cost, increased fuel economy, higher octane rating (anti-knock quality), and decreased exhaust emissions.

For instance, the use of absolute ethanol (200 proof ethanol) as a fuel component and octane improver in blends with gasoline is well known in the art, as seen e.g. by commercial "gasohol" which consists essentially or a 90/10 volume percent blend of gasoline and absolute ethanol. However, fuel composition blends of gasoline and ethanol are very sensitive to water contamination and in general have heretofore exhibited a very limited phase stability tolerance for water, particularly at low temperatures of about 0° C. and below. Moreover, it is well known that such phase separation into a gasoline-rich phase and an ethanol-water phase can result and lead to severe internal combustion engine operation problems, e.g. stalling, fuel line freezing, and the like. Such phase separation probability is believed to be the primary reason that the only commercially available gasoline-ethanol fuel compositions are those prepared using absolute ethanol instead of hydrous ethanol. Moreover while a gasoline-ethanol fuel composition producer may take precautions to avoid phase separation by excluding water during the production, storage and distribution of such fuel compositions, there is little, if anything, that can be done by the producer to avoid water contamination during the retail marketing and/or individual use of such fuel compositions.

Consequently, the discovery of gasoline-ethanol fuel compositions having improved phase stability tolerances to water over a wide temperature range such as those that would have cloud points of 0° C. or below, while at the same time having octane ratings above that of the gasoline employed, would obviously be of no small importance to the state of the art. Such superior phase-stable fuel compositions would permit the use of hydrous ethanol instead of absolute ethanol in the production of said fuel compositions and such an accomplishment in itself would lead to a wide variety of obvious benefits, not the least of which is the fact that the production of hydrous ethanol is less energy-intensive than the production of absolute ethanol and thus is far easier and much less expensive to product.

Indeed, the search for phase-stable gasoline-hydrous ethanol fuel compositions suitable for use in internal combustion engines has been a long and constant one in the art as seen e.g. by the following prior art.

U.S. Pat. Nos. 4,207,076 and 4,207,077 are directed to fuel compositions consisting of a major amount of gasoline, a minor amount of 190 proof ethanol and an alkyl-t-butyl ether as a cosolvent.

U.S. Pat. No. 3,822,119 is directed to an anti-pollution, anti-knock fuel composition comprising a mixture of gasoline, water and an alcohol containing from 4 to 8 carbon atoms. Said patent further discloses that additionally simple alcohols such as methanol, ethyl alcohol, n-propyl or isopropyl can be employed as a solubilizing agent.

A technical paper entitled "Use of 95% Ethanol in Mixtures With Gasoline" by A. Schmidt, in Comm. Eur. Communities [Rep." EUR June 1981, EUR 7091, Energy Biomass, Conf., 1st pp. 928–933 (Eng.) is directed to gasoline-95% ethanol mixtures and their phase stability at low temperatures as well as to the use of propanols or butanols as co-solvents.

*Hydrocarbon Processing,* May, 1979, pp. 127 to 138, contains an article "Alcohols as Motor Fuels?" by J. Keller which discusses gasoline blends of methanol and ethanol along with higher alcohols as a cosolvent to improve water tolerance (page 133).

U.S. Pat. No. 2,104,021 is directed to fuel compositions for internal combustion engines comprising a non-benzenoid hydrocarbon composition, water, ethanol, and as stabilizing agents therefore, a saturated aliphatic ether and a higher alcohol, in a quantity sufficient to maintain a homogeneous mixture or blend at sub-zero temperatures.

However, none of the above prior art references is seen to disclose an example of a single specific gasoline-ethanol fuel composition as encompassed by the invention of this application, nor are said references seen to render obvious the unique combination of phase stability and high octane properties possessed by the fuel compositions of this invention.

DISCLOSURE OF THIS INVENTION

Thus, it is an object of this invention to provide novel phase-stable aqueous gasoline-ethanol fuel compositions for use in internal combustion engines, said compositions not only having a cloud point of below 0° C., but also having an octane rating above both that of the gasoline employed as well as above that of a comparable non-aqueous mixture of said gasoline and ethanol. It is a further object of this invention to provide a novel method (process) for preparing said phase-stable aqueous gasoline-ethanol fuel compositions. Other objects and advantages of this invention will become readily apparent from the following description and appended claims.

More specifically, this invention is directed to a phase-stable aqueous gasoline-ethanol fuel composition consisting essentially of gasoline, water, ethanol and an additional alcohol selected from the group consisting of n-butanol, 2-butanol, iso-butanol, 2-methyl-1-butanol, 3-methyl-1-butanol, n-pentanol, and mixtures thereof, wherein the amount of water and ethanol present in said composition is equivalent to said composition containing a hydrous ethanol having a proof of from about 188 to about 199 in an amount ranging from about 1 to about 12 weight percent and wherein the amount of said additional alcohol present in said composition ranges from about 2 to about 4 weight percent, the remainder of said composition consisting essentially of said gasoline, said composition further having a cloud point of about −8° C. or below and a (R+M)/2 octane rating above both that of the gasoline employed as well as above that of a non-aqueous mixture of said gasoline and an amount of ethanol equal to the amount of ethanol present in said composition.

Alternatively, this invention may be described as a method for preparing a phase-stable aqueous gasoline-ethanol fuel composition for use in internal combustion engines, said composition having a cloud point of about −8° C. or below, a (R+M)/2 octane rating above both that of the gasoline employed as well as above that of a nonaqueous mixture of said gasoline and an amount of ethanol equal to the amount of ethanol present in said composition, which comprises mixing gasoline, water and ethanol, with an additional alcohol selected from the group consisting of n-butanol, 2-butanol, iso-butanol, 2-methyl-1-butanol, 3-methyl-1-butanol, n-pentanol, and mixtures thereof, wherein the amount of water and ethanol present in said composition is equivalent to said composition containing a hydrous ethanol having a proof of from about 188 to about 199 in an amount ranging from about 1 to about 12 weight percent and wherein the amount of said addition alcohol present in said composition ranges from about 2 to about 4 weight percent, the remainder of said composition consisting essentially of said gasoline.

DETAILED DESCRIPTION

As noted herein above, the phase-stable aqueous gasoline-ethanol fuel compositions of this invention consist essentially of gasoline, water, ethanol and an additional alcohol selected from the group consisting of n-butanol, 2-butanol, iso-butanol 2-methyl-1-butanol, 3-methyl-1-butanol, n-pentanol, and mixtures thereof.

It has been surprisingly discovered that by mixing said composition components that a phase-stable aqueous gasoline-ethanol fuel composition can be prepared which has a cloud point of about −8° C. or below and in addition a (R+M)/2 octane rating above both that of the gasoline employed as well as above that of a non-aqueous "gasohol" type mixture of said gasoline and an amount of ethanol equal to the amount of ethanol present in said composition.

The gasoline component employable in the fuel compositions of this invention may be any conventionally known gasoline base stock, including hydrocarbon fuel mixtures having a gasoline boiling range of about 30° C. to about 215° C. Methods for obtaining such gasoline base stocks and hydrocarbon mixtures are well known in the art and obviously need not be enumerated herein. More specifically the gasoline components employable in this invention are those having an aromatic content of from about 10 to about 50 percent by volume, preferably about 20 to about 40% by volume. In addition, the more preferred gasoline components have a (R+M)/2 octane rating ranging from about 75 to about 89, although gasoline components having higher or lower octane ratings may be employed, if desired. Likewise, while leaded gasoline components may be employed in this invention, it is more preferred to employ an unleaded gasoline component for obvious anti-pollution reasons.

Thus in accordance with the present invention gasoline, water and ethanol are mixed with an additional alcohol selected from the group consisting of n-butanol, 2butanol, iso-butanol, 2-methyl-1-butanol, 3-methyl-1-butanol, n-pentanol, and mixtures thereof, the most preferred additional alcohol being iso-butanol.

The components of the fuel compositions of this invention may be employed singularly or as mixtures and mixed in any order using any mixing or blending apparatus and technique desired.

The amount of water and ethanol present in the fuel composition of this invention is equal to that amount which would be equivalent to said composition containing a hydrous ethanol having a proof of from about 188 to about 199 in an amount ranging from about 1 to about 12 weight percent. Thus it is to be understood that while it would be preferred to employ said water and ethanol in the form of such a hydrous ethanol in such amounts, the fuel compositions of this invention can alternatively be produced, if desired, using anhydrous (200 proof) ethanol, sufficient water being provided by an alternative means to arrive at a fuel composition that would be equivalent to a composition containing hydrous ethanol in the proof and amount desired by this invention. In general it is preferred that the amount of water and ethanol present in the fuel composition of this invention be equivalent to said composition containing a hydrous ethanol having a proof of from about 188 to about 193 in an amount ranging from about 8 to about 11 weight percent and more preferably a hydrous ethanol having a proof of about 190 in an amount of about 10 weight percent.

The amount of additional alcohol selected from the group consisting of n-butanol, 2-butanol, iso-butanol, 2-methyl-1-butanol, 3- methyl-1-butanol, n-pentanol, and mixtures thereof that may be present in the fuel composition of this invention may range from about 2 to about 4 percent by weight. While amounts of additional alcohol having above 4 percent by weight can also lead to fuel compositions having a cloud point of about −8° C. or below, such higher amounts are not necessary to achieve the desired results of the subject invention and thus are considered to be economically wasteful.

Moreover, it is to be understood that while selection of the various fuel composition component amounts required to achieve the results desired will be dependent upon one's experience in the utilization of the subject invention, only a minimum measure of experimentation should be necessary in order to ascertain those component amounts which will be sufficient to produce the desired results for any given situation.

Moreover, while the remainder of the fuel composition in addition to said above-discussed water, ethanol and additional alcohol components consists essentially of said gasoline component, it is of course to be understood that the fuel composition may, if desired, contain 0 to about 0.1 weight percent of any suitable conventional corrosion inhibitor, metal deactivator or antioxidant.

As employed herein and as well known in the art, "(R+M)/2" represents the fuel composition's octane number or rating which is calculated by averaging the sum of said fuel composition's research octane number (RON), measured according to ASTM Method D2699 and its motor octane number (MON), measured according to ASTM Method D2700. As further employed herein the term "cloud point" represents that temperature in degrees Centigrade at which the fuel composition changes from a clear and transparent fluid to one which is cloudy.

The subject invention is indeed unique and beneficial in that it allows for highly phase-stable gasoline-ethanol fuel compositions suitable for use in conventional non-dual injection spark-ignition internal combustion engines to be prepared utilizing hydrous ethanol. The fuel compositions of this invention possess thermodynamic stability over a wide range of temperatures as low as about −8° C. or below. Moreover the ability to employ hydrous ethanol, the production of which is less energy-intensive than anhydrous ethanol, eliminates the economical need of costly distillation requirements attendant to the production of anhydrous ethanol from renewable, non-petroleum sources, thus providing a highly economical and easily preparable fuel blend. At the same time the subject invention allows for the use of anhydrous (200 proof) ethanol in the refinery as an octane additive to the gasoline, since detrimental phase separation problems which can be caused by contamination with even small amounts of water may be overcome by the make-up of the fuel composition of this invention.

In addition to such excellent thermodynamic stability, fuel compositions of this invention have been found to possess a (R+M)/2 octane rating above not only that of the gasoline employed, but also above that of a non-aqueous "gasohol" type mixture of said gasoline and an amount of ethanol equal to the amount of ethanol present in said fuel composition. Thus the subject invention offers a means for improving the octane rating (anti-knock quality) of not only gasoline, but gasohol as well. Further evidence has been found to indicate that the fuel compositions of this invention may provide excellent fuel economy which suggests decreased exhaust emissions as well.

The following examples are illustrative of the present invention and are not to be regarded as limitative. It is to be understood that all of the parts, percentages and proportions referred to herein and in the appended claims are by weight unless otherwise noted.

EXAMPLES 1-3

Three series of fuel compositions were prepared in which the amount of gasoline, the amount of water and the amount of ethanol were maintained constant while a constant amount of different additional alcohols was mixed with the base composition. The gasoline employed in each instance was an unleaded gasoline which had a (R+M)/2 octane rating of about 87 and contained about 30% by volume of aromatics, while the amount of water and ethanol employed in each instance was equivalent to employing about 191 proof ethanol. The additional alcohols employed in each instance were n-butanol, iso-butanol, t-butanol, n-pentanol, and a mixture of primary amyl alcohols (analysis: about 98.7 wt. % total amyl alcohol; about 66.14 wt. % n-pentanol and about 32.56 wt. % 2-methyl-1-butanol and 3-methyl-1-butanol). In one series (Example 2 ) about 86.0 grams of gasoline, about 10.0 grams of anhydrous (200 proof) ethanol and about 0.6 grams of water were mixed with about 2.0 grams of the additional alcohol. In like manner the two additional series of fuel compositions were prepared, Example 1 using about 43.0 grams of gasoline, about 5.0 grams of anhydrous (200 proof) ethanol, about 0.3 grams of water and about 0.5 grams of the additional alcohol and Example 3 using about 43.0 grams of gasoline, about 5.0 grams of anhydrous (200 proof) ethanol, about 0.3 grams of water and about 1.5 grams of the additional alcohol. Without the additional alcohol the equivalent gasoline/anhydrous (200 proof) ethanol/water mixture had a cloud point of 14° C. The cloud points of the resulting compositions were then measured and are recorded below.

| Additional Alcohol | Example 1 Cloud point (°C.) of 88.12 wt. % gasoline, 10.25 wt. % 200° ethanol, 0.61 wt. % water, 1.02 wt. % additional Alcohol | Example 2 Cloud point (°C.) of 87.22 wt. % gasoline, 10.14 wt. % 200° ethanol, 0.61 wt. % water, 2.03 wt. % additional Alcohol | Example 3 Cloud point (°C.) of 86.35 wt. % gasoline, 10.04 wt. % 200° ethanol, 0.60 wt. % water, 3.01 wt. % additional Alcohol |
|---|---|---|---|
| n-butanol | −7 | −20 | −41 |
| iso-butanol | −3 | −19 | −35 |
| t-butanol | 8 | 5 | −3 |
| n-pentanol | −6 | −25 | −43 |
| mixture of primary amyl alcohols | −5 | −22 | −40 |

Note that the t-butanol failed to provide a cloud point of −8° C. even at the 3.0 weight percent level.

EXAMPLE 4

A systematic study was performed on the temperature stability of four fuel compositions consisting of an unleaded gasoline having a (R+M)/2 octane rating of about 87 and containing about 30% by volume of aromatics, said composition also containing ethanol, water and an additional alcohol selected from the group consisting of n-butanol, iso-butanol, n-pentanol and a mixture of primary amyl alcohols (analysis: about 98.7 wt. % total amyl alcohol; about 66.14 wt. % n-pentanol and about 32.56 wt. % 2-methyl-1-butanol and 3-methyl-1-butanol). The procedure was as follows. First to 42.76 grams of the base gasoline was added 5.24 grams of 200 proof denatured ethanol. The ethanol used was denatured with 4.54 weight percent of the same gasoline used, thus in effect one started out with 43 grams of gasoline and 5 grams of ethanol. To the gasoline/ethanol mixture was added 1 gram of the additional alcohol and enough water so that the contained ethanol/water would correspond to 191 proof ethanol and the cloud point of the compositions determined. Then more water was added so that the ethanol/water contained would correspond to 190 proof ethanol and the cloud points determined again. Then keeping the contained ethanol/water at 190 proof, another 0.5 grams of the additional alcohol was added and the cloud points measured again. Then more water was added so that the contained ethanol/water corresponded to 189 proof ethanol and the cloud points measured again. Below are the reported results of said measured cloud points and their relationship to the amount and type of additional alcohol employed and to the corresponding ethanol proof of the ethanol/water contained in each composition.

| Additional Alcohol | Wt % Additional Alcohol | Ethanol Proof | Cloud Point, °C. |
|---|---|---|---|
| n-butanol | 2.0 | 191 | −20° C. |
| n-butanol | 2.0 | 190 | −9° C. |
| n-butanol | 3.0 | 190 | −25° C. |
| n-butanol | 3.0 | 189 | −13° C. |

-continued

| Additional Alcohol | Wt % Additional Alcohol | Ethanol Proof | Cloud Point, °C. |
|---|---|---|---|
| iso-butanol | 2.0 | 191 | −19° C. |
| iso-butanol | 2.0 | 190 | −8° C. |
| iso-butanol | 3.0 | 190 | −23° C. |
| iso-butanol | 3.0 | 189 | −11° C. |
| n-pentanol | 2.0 | 191 | −25° C. |
| n-pentanol | 2.0 | 190 | −13° C. |
| n-pentanol | 3.0 | 190 | −32° C. |
| n-pentanol | 3.0 | 189 | −17° C. |
| mixture of primary amyl alcohols | 2.0 | 191 | −22° C. |
| mixture of primary amyl alcohols | 2.0 | 190 | −10° C. |
| mixture of primary amyl alcohols | 3.0 | 190 | −26° C. |
| mixture of primary amyl alcohols | 3.0 | 189 | −15° C. |

The above data shows that at constant amount of water and constant amount of contained ethanol/water (i.e. ethanol proof), the cloud point decreased with the amount of additional alcohol added. Also at constant amount of additional alcohol, the cloud point increased with increasing amounts of water.

EXAMPLE 5

Three fuel compositions designated $G_5$, $G_6$ and $G_7$, each containing about 86.3 weight percent gasoline, about 10.7 weight percent of 190 proof ethanol and about 3.0 weight percent of an additional alcohol were prepared and evaluated versus unleaded gasoline and "gasohol" (90/10% by volume mixture of gasoline and anhydrous (200 proof) ethanol) in terms of their research octane number (RON) and motor octane number (MON). Designated fuel composition $G_5$ employed a mixture of primary amyl alcohols (analysis: about 98.7 wt. % total amyl alcohol; about 66.14 wt. % n-pentanol and about 32.56 wt. % 2-methyl-1-butanol and 3-methyl-1-butanol) and had a cloud point of −26° C., designated fuel composition $G_6$ employed n-butanol and had a cloud point of −25° C., while designated fuel composition $G_7$ employed iso-butanol and had a cloud point of −23° C. A fuel composition designated $G_8$ and containing about 84.53 wt. % of gasoline, about 10.71 wt. % of 188 proof ethanol and about 4.76 wt. % of a mixture of primary amyl alcohols (analysis: about 98.7 wt. % of total amyl alcohol; about 66.14 wt. % n-pentanol and about 32.56 wt. % 2-methyl-1-butanol and 3-methyl-1-butanol) was also prepared, said designated fuel composition having a cloud point of −26° C. All four said designated compositions and the gasohol were prepared using the same unleaded gasoline base fuel which contained about 30 percent aromatics by volume. Then all four designated fuel compositions were evaluated versus the unleaded gasoline employed and "gasohol" (90/10% by volume mixture of said gasoline and anhydrous (200 proof) ethanol) in terms of their research octane number (RON) and motor octane number (MON). The octane measurements were performed on standard test equipment using ASTM Method D 2699 measure RON and ASTM Method D 2700 to measure MON. The (R+M)/2 octane rating for each fuel was calculated by averaging the values of RON and MON. The octane numbers measured were as follows:

| Fuel | RON | MON | (R + M)/2 |
|---|---|---|---|
| Unleaded Gasoline | 89.4 | 84.2 | 86.8 |
| Gasohol | 95.4 | 86.2 | 90.8 |
| $G_5$ | 96.9 | 86.6 | 91.8 |
| $G_6$ | 95.7 | 86.3 | 91.0 |
| $G_7$ | 96.7 | 86.8 | 91.8 |
| $G_8$ | 95.7 | 86.0 | 90.8 |

Said data shows that the (R+M)/2 octane values of fuels $G_5$, $G_6$ and $G_7$ of this invention are much higher than the corresponding value for the base unleaded gasoline and are also higher than the corresponding value for the "gasohol" tested, while fuel $G_8$, not of this invention, did not have a (R+M)/2 value above that of the "gasohol". Moreover an evaluation of the physical properties of fuel composition $G_7$ showed that it meets all of the standard specifications for automotive gasoline (ASTM D439) with the exception of the 50 percent distillation point which should not be below 170° F.

EXAMPLE 6

The same unleaded gasoline, "gasohol" and $G_5$, $G_6$, $G_7$ and $G_8$ fuel compositions employed in Example 5 above were also evaluated for fuel economy. The fuel economy measurements were obtained on a dynanometer-mounted 2.3 liter 4-cylinder Ford Pinto engine using a test procedure optimized to detect small differences in fuel consumption. The fuel economy was measured at five engine operating conditions described in terms of RPM (revolutions per minute) and BHP (brake horsepower). Engine parameters, such as spark-timing, were set in such a way as to obtain optimum performance with the base unleaded gasoline fuel.

The percent change (gain or loss) in fuel economy based on an average of twenty runs for each RPM/BHP operating mode conducted for the same period of time for each fuel in terms of the fuel consumption of the gasohol, $G_5$, $G_6$, $G_7$ and $G_8$ fuels versus that of the base unleaded gasoline is reported below.

| Operating Mode | % Change in Fuel Economy Over Base Unleaded Gasoline | | | | |
|---|---|---|---|---|---|
| | Fuels | | | | |
| RPM/BHP | Gasohol | $G_5$ | $G_6$ | $G_7$ | $G_8$ |
| 1000/0.25 | 0.7** | 0.6** | 1.0* | 1.7*** | 0.7** |
| 1750/4.8 | 0.6** | 3.2**** | 0.7* | 1.0*** | 0.6*** |
| 1750/9.6 | 0.6*** | 2.2**** | 0.2* | 0.2** | 2.8**** |
| 2500/17.5 | −0.4** | 0.9** | 0.2* | 1.6**** | 1.2**** |
| 2500/21.2 | −0.4** | 0.0* | −0.1* | 0.3** | −1.8**** |

*Statistical significance at less than 90 percent probability level.
**Statistical significance at the 90 percent probability level.
***Statistical significance at the 95 percent probability level.
****Statistical significance at the 99 percent probability level.

Said data indicates that the $G_5$, $G_6$ and $G_7$ fuel compositions of this invention provided better fuel economy than the base unleaded gasoline while that of the $G_5$ and $G_7$ fuel composition was even clearly better than that of the gasohol. While said laboratory test procedure can be used only to determine relative fuel consumption of various fuels, such procedures are satisfactory for base comparisons and screening purposes. Moreover, the higher octane numbers of the $G_5$, $G_6$ and $G_7$ fuel compositions shown in Example 5 suggest that optimizing the spark-timing of the engine to take advantage of the higher (R+M)/2 octane ratings could result in further lowering the fuel consumption of said compositions relative to the base unleaded gasoline by a significant amount thereby evidencing an even greater gain in fuel economy.

EXAMPLE 7

The following series of fuel compositions were prepared employing an unleaded gasoline that had a (R+M)/2 octane rating of about 87 and contained about 30 percent aromatics by volume and their cloud points determined.

Composition A
85.44 wt. % gasoline
10.60 wt. % 190 proof ethanol
3.96 wt. % iso-butanol
Cloud Point −35° C.

Composition B
86.3 wt. % gasoline
10.7 wt. % 190 proof ethanol
3.0 wt. % 2-butanol
Cloud Point −10° C.

An early cloud point determination of the same Composition B gave a reading of −3° C., however, said experiment is considered to have been inaccurate due to additional water contained in the 2-butanol sample.

Composition C
86.1 wt. % gasoline
11.0 wt. % 190 proof ethanol
2.9 wt. % mixture of 15% iso-butanol 85% n-butanol
Cloud point −20° C.

Composition D
85.25 wt. % gasoline
10.90 wt. % 190 proof ethanol
3.85 wt. % mixture of 15% iso-butanol and 85% n-butanol
Cloud Point −27° C.

The water content in said Composition D was increased first to effect a composition having 189 proof ethanol and then to effect a composition having 188 proof ethanol. The cloud points of these new compositions were now −24° C. and −14° C. respectively.

Composition E
85.25 wt. % gasoline
10.90 wt. % 190 proof ethanol
3.85 wt. % n-butanol
Cloud Point −35° C.

Composition F
85.25 wt. % gasoline
10.90 wt. % 190 proof ethanol
3.85 wt. % n-pentanol
Cloud Point −41° C.

-continued

Composition G
85.25 wt. % gasoline
10.90 wt. % 190 proof ethanol
3.85 wt. % mixture of primary amyl alcohols (analysis: about 99.6 wt. % total amyl alcohol; 61.2 wt. % n-pentanol and about 38.4 wt. % 2-methyl-1-butanol and 3-methyl-1-butanol)
Cloud Point −35° C.

Another cloud point determination of the same composition using a crude mixture of primary amyl alcohols gave a cloud point of −27° C.

Composition H
86.08 wt. % gasoline
11.01 wt. % 190 proof ethanol
2.91 wt. % mixture of primary amyl alcohols (same analysis as in composition G.)
Cloud Point −18° C.

Composition I
85.12 wt. % gasoline
11.04 wt. % 188 proof ethanol
3.84 wt. % mixture of primary amyl alcohols (same analysis as in Example 4)
Cloud Point −11° C.

EXAMPLE 8

A series of fuel compositions were prepared using a gasoline having a (R+M)/2 octane rating of about 87 and containing about 30 percent aromatics by volume, anhydrous (200 proof) ethanol and iso-butanol wherein the amount of water was varied to effect different proofs of ethanol. The results of said experiments are given below.

| Gasoline Wt. % | 200 Proof Ethanol Wt. % | Water Wt. % | Iso-butanol Wt. % | Effected Proof of Ethanol | Cloud Pt., °C. |
|---|---|---|---|---|---|
| 90.62 | 5.19 | 0.35 | 3.85 | 189.9 | −33 |
| 90.58 | 5.19 | 0.38 | 3.85 | 189.1 | −23 |
| 90.53 | 5.19 | 0.44 | 3.84 | 187.5 | −14 |
| 90.49 | 5.18 | 0.48 | 3.84 | 186.4 | 20 |

Various modifications and variations of this invention will be obvious to a worker skilled in the art and it is to be understood that such modifications and variations are to be included within the purview of this application and the spirit and scope of the appended claims.

I claim:

1. A phase-stable aqueous gasoline-ethanol fuel composition consisting essentially of gasoline, water ethanol and iso-butanol, wherein the amount of water and ethanol present in said composition is equivalent to said composition containing a hydrous ethanol having a proof or from about 188 to about 199 in an amount ranging from about 1 to about 12 weight percent and wherein the amount of iso-butanol present in said composition ranges from about 2 to about 4 weight percent, the remainder of said composition consisting essentially of said gasoline, said composition further having a cloud point of about −8° C. or below and a (R+M)/2 octane rating above both that of the gasoline employed as well as above that of a non-aqueous mixture of said gasoline and an amount of ethanol equal to the amount of ethanol present in said composition.

2. A composition as defined in claim 1, wherein the gasoline has a (R+M)/2 octane rating of from about 75 to about 89 and an aromatic content of from about 10 to about 50 percent by volume.

3. A composition as defined in claim 2, wherein the gasoline has an aromatic content of from about 20 to about 40 percent of volume and the amount of ethanol and water present in said composition is equivalent to hydrous ethanol having a proof ranging from about 188 to about 193 in an amount ranging from about 8 to about 11 weight percent.

4. A composition as defined in claim 3, wherein the amount of ethanol and water present is equivalent to hydrous ethanol having a proof of about 190 and wherein the amount of iso-butanol is about 3 weight percent.

5. A method for preparing a phase-stable aqueous gasoline-ethanol fuel composition for use in internal combustion engines, said composition having a cloud point of about 31 8° C. or below, (R+M)/2 octane rating above both that of the gasoline employed as well as above that of a non-aqueous mixture of said gasoline and an amount of ethanol equal to the amount of ethanol present in said composition, which comprises mixing gasoline, water and ethanol, with iso-butanol, wherein the amount of water and ethanol present in said composition is equivalent to said composition containing a hydrous ethanol having a proof of from about 188 to about 199 in an amount ranging from about 1 to about 12 weight percent and wherein the amount of iso-butanol present in said composition ranges from obout 2 to about 4 weight percent, the remainder of said composition consisting essentially of said gasoline.

6. A method as defined in claim 5, wherein the gasoline has a (R+M)/2 octane rating from about 75 to about 89 and an aromatic content of from about 10 to about 50 percent by volume.

7. A method as defined in claim 5, wherein the gasoline has an aromatic content of from about 20 to about 40 percent by volume and the amount of ethanol and water present in said composition is equivalent to hydrous ethanol having a proof ranging from about 188 to about 193 in an amount range from about 8 to 11 weight percent.

8. A method as defined in claim 5, wherein the amount of ethanol and water present in said composition is equivalent to hydrous ethanol having a proof of about 190 and wherein the amount of iso-butanol is about 3 weight percent.

9. A method as defined in claim 5, wherein the ethanol and water are employed in the form of hydrous ethanol.

* * * * *

UNITED STATES PATENT AND TRADEMARK OFFICE

CERTIFICATE OF CORRECTION

PATENT NO. : 4,541,836

DATED : Sept. 17, 1985

INVENTOR(S) : Edmond J. Derderian

It is certified that error appears in the above-identified patent and that said Letters Patent is hereby corrected as shown below:

Add the following additional listing of patents and publications to the "References Cited".

U.S. PATENT DOCUMENTS

| | | | |
|---|---|---|---|
| 1,361,153 | 1920 | Hayes | |
| 1,412,233 | 1922 | Ellis | |
| 1,469,053 | 1923 | Schreiber | |
| 1,474,135 | 1923 | Backhaus | |
| 1,474,983 | 1923 | Schreiber | |
| 1,504,837 | 1924 | Ricardo | |
| 1,516,907 | 1924 | Backhaus | |
| 1,614,735 | 1927 | Kirschbraun | |
| 1,622,572 | 1927 | Chandler | |
| 1,684,686 | 1928 | Records | |
| 1,811,552 | 1931 | Mann, Jr. | |
| 1,907,309 | 1933 | VanSchaack, Jr. | |
| 2,078,736 | 1937 | Schurink | 44/9 |
| 2,111,100 | 1938 | Kokatnur | 44/9 |
| 2,128,987 | 1938 | Christensen | 44/9 |
| 2,408,999 | 1946 | Robertson | 44/53 |
| 2,429,707 | 1947 | Catalano | |

UNITED STATES PATENT AND TRADEMARK OFFICE

CERTIFICATE OF CORRECTION

PATENT NO. : 4,541,836

DATED : Sept. 17, 1985

INVENTOR(S) : Edmond J. Derderian

It is certified that error appears in the above-identified patent and that said Letters Patent is hereby corrected as shown below:

U.S PATENT DOCUMENTS (Cont.)

| | | | |
|---|---|---|---|
| 2,504,361 | 1950 | Van Hartesveldt | 44/53 |
| 2,543,514 | 1951 | Van Hartesveldt | 44/53 |
| 2,637,635 | 1953 | McLaughlin et al | 44/53 |
| 2,643,942 | 1953 | Barusch | 44/56 |
| 2,776,262 | 1957 | Denison et al | 252/586 |
| 2,884,314 | 1959 | Smith | 44/53 |
| 2,897,067 | 1959 | Sparks et al | 44/56 |
| 3,006,142 | 1961 | Carr | 60/35.4 |
| 3,346,494 | 1967 | Robbins et al | 252/33.2 |
| 3,490,237 | 1970 | Lissant | 60/217 |
| 3,527,581 | 1970 | Brownawell et al | 44/51 |
| 3,560,173 | 1971 | Coffey et al | 44/56 |
| 3,832,149 | 1974 | Kozlowski et al | 44/56 |
| 3,876,391 | 1975 | McCoy et al | 44/51 |
| 4,002,435 | 1977 | Wenzel et al | 44/51 |
| 4,046,519 | 1977 | Piotrowski | 44/51 |
| 4,083,698 | 1978 | Wenzel et al | 44/51 |
| 4,129,421 | 1978 | Webb | 44/56 |
| 4,145,190 | 1979 | Webb | 44/56 |
| 4,154,580 | 1979 | Landis | 44/56 |

UNITED STATES PATENT AND TRADEMARK OFFICE

CERTIFICATE OF CORRECTION

PATENT NO. : 4,541,836

DATED : Sept. 17, 1985

INVENTOR(S) : Edmond J. Derderian

It is certified that error appears in the above-identified patent and that said Letters Patent is hereby corrected as shown below:

U.S. PATENT DOCUMENTS (Cont.)

| | | | |
|---|---|---|---|
| 4,158,551 | 1979 | Feuerman | 44/51 |
| 4,251,231 | 1981 | Baird | 44/56 |
| 4,255,158 | 1981 | King | 44/56 |
| 4,261,702 | 1981 | Sweeney et al | 44/56 |
| 4,282,007 | 1981 | Sung | 44/53 |
| 4,282,008 | 1981 | Sung | 44/53 |
| 4,295,859 | 1981 | Boehmke | 44/51 |
| 4,297,107 | 1981 | Boehmke | 44/51 |

FOREIGN PATENT DOCUMENTS

| | | |
|---|---|---|
| 2626883 | 1977 | Germany |
| 49995 | 4/82 | European Pat. App. Publication |

OTHER PUBLICATIONS

Chem. Abs. Vol. 96 No. 24, 202201 J (June 1982); "Use of 95% Ethanol in Mixtures With Gasoline" by A. Schmidt - First Energy Biomass Conf., Comm. European Communities pp. 928 to 933, Nov. 1980, Published June 5, 1981.

UNITED STATES PATENT AND TRADEMARK OFFICE

CERTIFICATE OF CORRECTION

PATENT NO. : 4,541,836

DATED : Sept. 17, 1985

INVENTOR(S) : Edmond J. Derderian

It is certified that error appears in the above-identified patent and that said Letters Patent is hereby corrected as shown below:

OTHER PUBLICATIONS (Cont.)

Hydrocarbon Processing, May 1979, pp. 127 to 138, "Alcohols As Motor Fuels" by J. Keller.

U.S. Dept. of Energy's Final Report; "Methanol Fuel Modification for Highway Vehicle Use" (July 1978) pp. i to xviii; a to p of Section III B.1.b.; II-9 to II-63 of Section II. A.2; II-69 to II-79 of Section II.A.5; 71 to 74 of Section III. B.2.C and 130 to 140 of Section III.B.7.

SAE Technical Paper Series No. 810,444, Emergency Transportation Fuels; Properties and Performance" by B. K. Bailey et al (1981)

SAE Technical Paper Series No. 820,261, "A Technical Assessment of Alcohol Fuels" by Alternate Fuels Committee of Engine Manufacturers Association, pp. 1 to 37; Feb. 22-26, 1982.

UNITED STATES PATENT AND TRADEMARK OFFICE

CERTIFICATE OF CORRECTION

PATENT NO. : 4,541,836

DATED : Sept. 17, 1985

INVENTOR(S) : Edmond J. Derderian

It is certified that error appears in the above-identified patent and that said Letters Patent is hereby corrected as shown below:

Claim 1, line 2, "water ethanol" should be ... water, ethanol ... .

Claim 1, line 6, "or" should be ... of ... .

Claim 5, line 4, "31 8°C." should be ... -8°C. ... .

Claim 5, line 4, before "(R+M/2" add the article ... a ... .

Signed and Sealed this

First Day of April 1986

[SEAL]

*Attest:*

*Attesting Officer*

DONALD J. QUIGG

*Commissioner of Patents and Trademarks*